US005582875A

United States Patent [19]

Ryosuke

[11] Patent Number: 5,582,875

[45] Date of Patent: Dec. 10, 1996

[54] APPARATUS AND METHOD FOR INSULATING A CONDUCTIVE PAINT DURING ELECTROSTATIC PAINTING

[75] Inventor: Sasaoka Ryosuke, Ube, Japan

[73] Assignee: Yugenkaisya Kotogawa Kenzai Kogyosho, Yamaguchi, Japan

[21] Appl. No.: 975,926

[22] PCT Filed: Jun. 30, 1990

[86] PCT No.: PCT/JP90/00857

§ 371 Date: Sep. 7, 1993

§ 102(e) Date: Sep. 7, 1993

[87] PCT Pub. No.: WO92/06146

PCT Pub. Date: Jan. 9, 1992

[51] Int. Cl.[6] ..... B05D 1/04; B05B 5/025

[52] U.S. Cl. ..... 427/475; 427/483; 118/621; 118/627

[58] Field of Search ..... 427/458, 475, 427/483; 118/621, 627, 629; 239/3, 690, 691; 361/228; 174/47

[56] References Cited

U.S. PATENT DOCUMENTS

| | | | |
|---|---|---|---|
| 3,893,620 | 7/1975 | Rokadia | 118/629 |
| 3,934,055 | 1/1976 | Tamny | 427/483 |
| 4,879,137 | 11/1989 | Behr et al. | 427/475 |
| 4,892,750 | 1/1990 | Soshi et al. | 427/475 |
| 4,995,560 | 2/1991 | Lasley et al. | 118/629 |

FOREIGN PATENT DOCUMENTS

| | | | |
|---|---|---|---|
| 3110148 | 9/1982 | Germany | 239/690 |
| 56-3108 | 1/1981 | Japan . | |

*Primary Examiner*—Shrive Beck
*Assistant Examiner*—Fred J. Parker
*Attorney, Agent, or Firm*—Morrison Law Firm

[57] ABSTRACT

A device electrically insulates the supply of paint for an electrostatic paint sprayer from the charged paint near the sprayer. In the electrostatic paint sprayer, the paint that is sprayed from a nozzle is charged to a high potential. Because the paint is electrically conductive, the charged paint will conduct charge toward the supply. The present invention runs the paint supply through a vessel of insulating material. The vessel has baffles with openings that divide the flow into droplets, thus creating a discontinuity in the supply stream. Charge accumulated on the interior wall of the vessel attracts oppositely charged droplets, causing them to accelerate and splatter against the interior wall. The resulting coating of electrically conductive paint on the interior wall can create an electrically conductive bridge that destroys the insulating effect of the device. To prevent charge from accumulating on the interior wall, conductors are placed on the outside of the vessel to bleed charge from the accumulated paint through the insulated vessel wall, thus lowering the potential of the interior wall and lessening the attraction for droplets and the attendant splatter caused by acceleration of droplets toward the wall.

14 Claims, 7 Drawing Sheets

APPARATUS AND METHOD FOR INSULATING A CONDUCTIVE PAINT DURING ELECTROSTATIC PAINTING

BACKGROUND

The present invention relates to a process and an apparatus for insulating a paint supply during electrostatic painting. More particularly, the present invention relates to a process and apparatus for preventing electrical continuity in a stream of electrically conductive paint, such as water-based or aqueous paint during electrostatic painting.

In conventional electrostatic painting, oil-based paint is used to achieve painting efficiency. In conventional electrostatic painting an electrode applies a charge to a paint drop as it exits a paint spraying nozzle, enabling the droplet to adhere to a painted surface at a lower potential. Conductive paints prevent the application of a charge to an exiting droplet by forming a conductive path from the paint spraying nozzle back to a paint supply which shorts a charge-applying electrode. Oil-based paint is well suited for electrostatic painting because it is nonconductive and therefore incapable of forming a conductive path. Yet, oil-based paint causes air pollution. Additionally, oil based paint is toxic and flammable. Current fire laws restrict its use.

Water-based paint is less toxic and less flammable than oil-based paint. Because water-based paint is electrically conductive (due to the ions naturally present in water), a paint supply stream drips through a paint spraying nozzle to prevent continuity.

Japanese Examined Patent Publication No. 56-3108 discloses a method for insulating an aqueous paint in electrostatic coating. The method for insulating the paint includes pumping an aqueous conductive paint into an insulated, sealed chamber. Paint enters the insulated, sealed chamber through a hole in the top and drops on top of a dome-shaped ceiling member. Paint flows from a raised center of the ceiling member to a lower edge and falls over a hole in the edge. Paint drops fall downward through holes in a series of circular dropping plates. Optimally, paint drips downwardly without touching an inner wall of the chamber.

However, as dripping paint enters a lower region of the chamber, the possibility that paint will adhere to an inner wall of the chamber increases. Once paint sticks to the inner wall, the inner wall becomes electrically conductive. A high voltage applied to a tip of a paint spraying nozzle charges the paint stuck on the inner wall. The charged paint adhering to the inner wall attracts oppositely-charged drops of paint to the inner wall. Paint eventually covers the entire inner wall of the chamber, creating a conductive path from the paint spraying nozzle to a paint supply. The conductive path shorts the electrode and prevents electrostatic painting.

The present inventor has discovered a method and apparatus that avoids the problems of conventional electrostatic painting.

OBJECTS AND SUMMARY OF THE INVENTION

It is a main object of this invention to provide an apparatus and a process for insulating an electrically conductive paint such as an aqueous paint during electrostatic painting.

According to an embodiment of the present invention, a process for preventing electrical continuity in a stream of a conductive paint in an electrostatic painting, includes:

pumping a stream of a conductive paint into an insulating chamber, dividing the stream into a plurality of radial substreams, dripping the paint downward through the chamber, bleeding a charge forming on paint adhering to an inner wall of the insulating chamber through the inner wall to a grounding electrode having a lower electric potential than that of the inner wall.

The process of preventing electrical continuity in the paint stream includes vertically stacking a plurality of containers to form the insulating chamber, forming openings in lower ends of each container, dripping the paint straight down through the openings, and attaching a grounding electrode on an outer wall of each container.

According to a further aspect of the present invention, an apparatus for preventing electrical continuity in a stream of conductive paint in electrostatic painting, includes: a storage container for storing the conductive paint, an insulating chamber for receiving and separating a paint stream, a plurality of radial channels for dividing the paint stream, a plurality of vertically-stacked containers forming the insulating chamber, an opening in each container for dripping the conductive paint, and a grounding electrode mounted on an outer wall of each container.

According to a further embodiment of the present invention, the openings in the stacked containers are corrugated circles, the diameter of each opening is larger than a paint dropping portion formed in an uppermost container, an opening of one of the containers disposed in the middle of the insulating chamber is larger than the opening of the uppermost container. The insulating chamber is air-tight.

According to a further advantage of the present invention, a continuous stream of conductive paint entering the insulating chamber becomes discontinuous because it is separated into a plurality of radially and vertically-spaced drops, Even though some of the paint sticks to the inner wall of the chamber and the inner wall becomes conductive, a grounding electrode on the outer wall of the chamber gradually bleeds excess charge from the paint stuck on the inner wall, through the inner wall, and to ground. Thus, grounding the outer wall of the chamber prevents charging of the inner wall, allowing paint to drop without sticking.

DETAILED DESCRIPTION OF THE PREFERRED EMBODIMENTS

Figure 1:
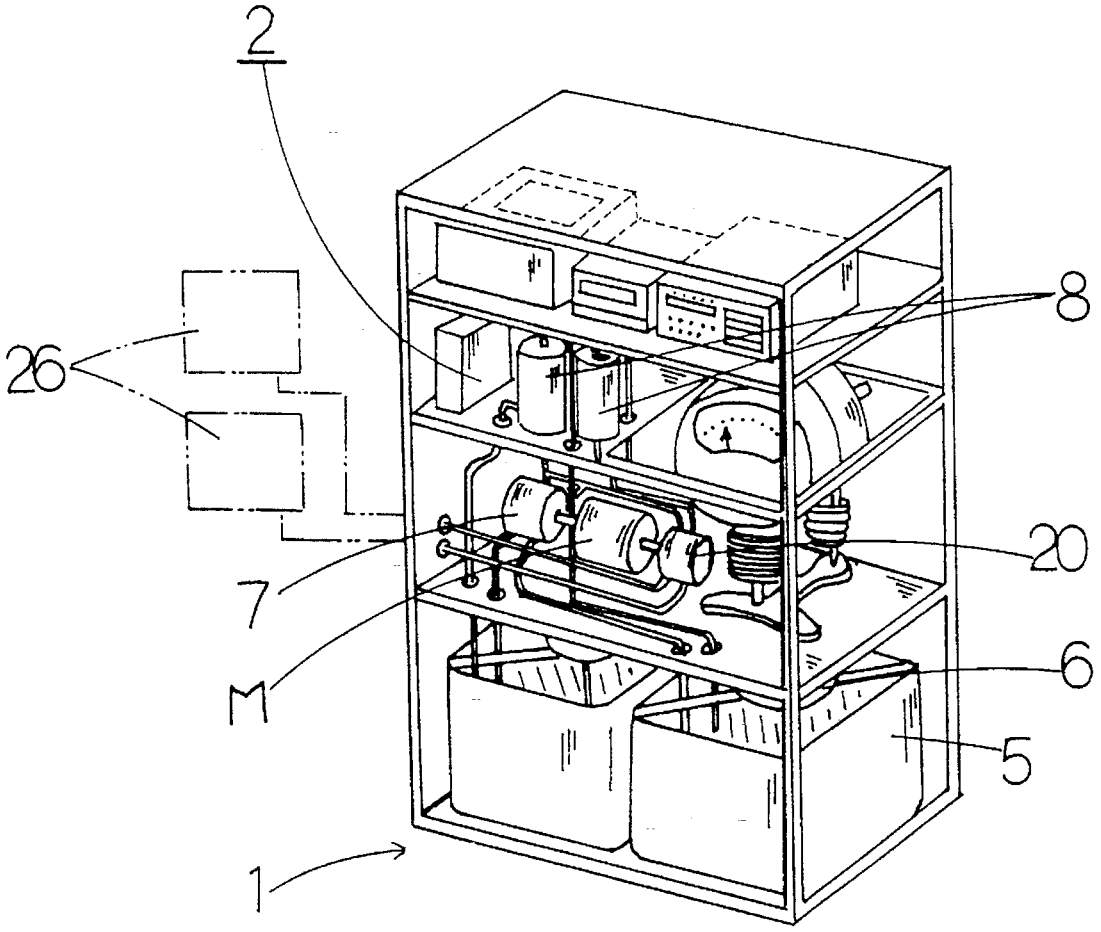
FIG. 1 is a perspective view of an apparatus for insulating a paint supply during electrostatic painting according to an embodiment of the present invention.
Figure 2:
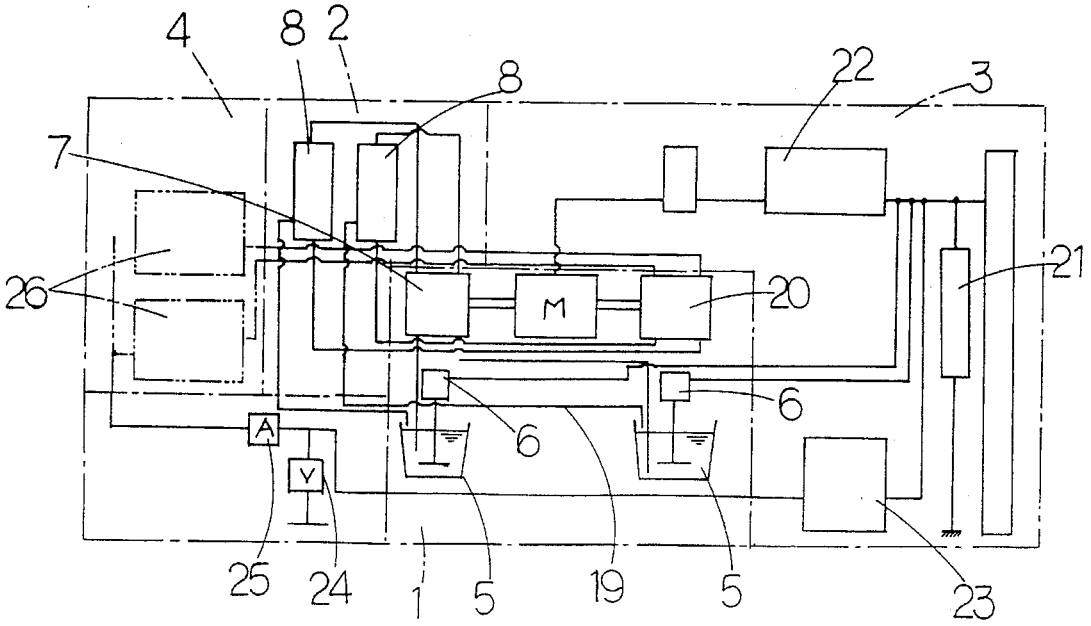
FIG. 2 is a block diagram according to the embodiment of FIG. 1.

Referring to FIGS. 1–2, according to an embodiment of the present invention, an apparatus for preventing electrical continuity in a stream of conductive paint in electrostatic painting includes: a paint supply 1, a paint insulator 2, a power source 3 and a paint spraying device 4. Paint exits the apparatus through a paint spraying nozzle 26.

Paint supply 1 includes a paint storage container 5, which stores a paint. An agitator 6 stirs paint stored in paint storage container 5. A low pressure pump 7 pumps paint in storage container 5 to paint insulating means 2. A pulse motor M drives low pressure pump 7 to supply a continuous stream of paint to paint insulator 2. Paint insulator 2 includes a pair of isolators 8, which electrically isolate paint stored in storage container 5 from the paint spraying nozzle 26. A high pressure pump 20 delivers paint from isolators 8 to the paint spraying nozzle 26.

Power source 3 includes a digital multimeter 21, a programmable controller 22, and a 100 V AC power supply 23. Power supply 23 applies a voltage sufficient to charge a paint drop as it exits the paint spraying nozzle 26. A voltmeter 24 measures the voltage applied to the paint spraying nozzle 26. An ammeter 25 measures a leakage current flowing to each grounding electrode 13*a*–13*f* (shown in FIG. 3).

Figure 3:
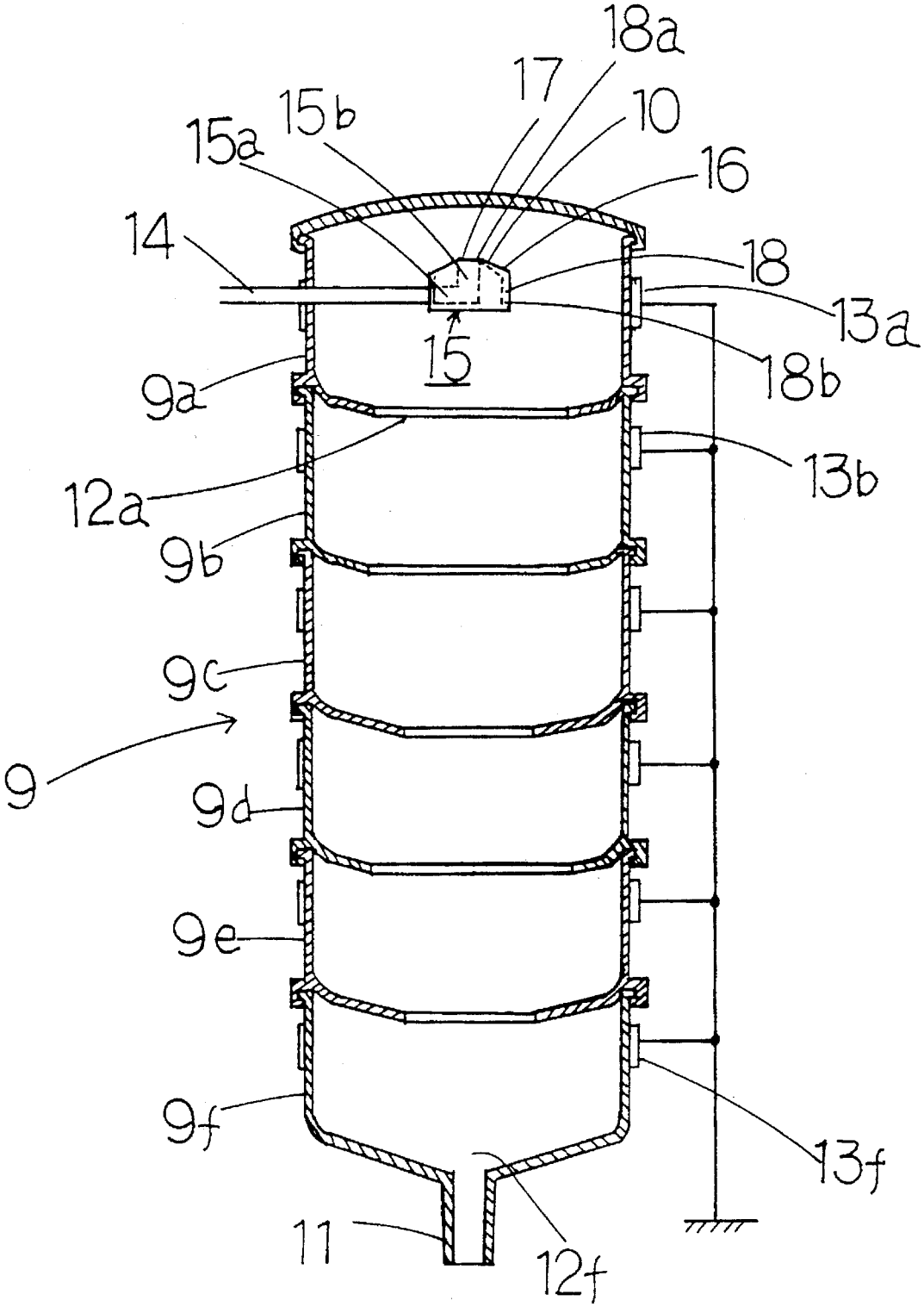
FIG. 3 is a sectional view of an insulating chamber according to the embodiment of FIG. 1.

Referring now to FIG. 3, each isolator 8 includes a sealed, hollow insulating chamber 9. Insulating chamber 9 includes a plurality of vertically-stacked insulating containers 9*a*, 9*b*, 9*c*, 9*d*, 9*e* and 9*f*. Insulating containers 9*a*–9*f* are preferably constructed of nonconductive plastic material such as polyethylene, polypropylene, polyester, or polycarbonate. Insulating containers 9*a*–9*f* are preferably removably attached to each other. Although the number of containers is optional, using five or more containers adequately insulates the paint.

A bottom portion of each insulating container 9*a*–9*f* has an annular opening 12*a*, 12*b*, 12*c*, 12*d*, 12*c*. During electrostatic painting, paint drips straight down through the openings 12*a*–12*f*. The openings 12*a*–12*f* are arranged coaxially to provide a straight path for paint drops.

The diameter of each opening 12*a*–12*f* is smaller than an opening above it.

Figure 6:
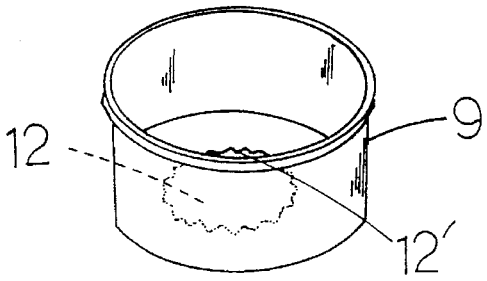
FIG. 6 is a perspective view of an insulating container.
Figure 8:
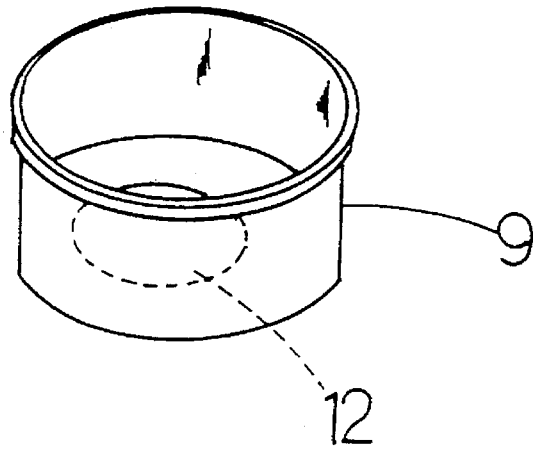
FIG. 8 is a perspective view of an insulating container according to a further embodiment of the present invention.

Referring to FIG. 6 and FIG. 8, openings 12 are circular. A corrugated circular circumference 12' is shown in FIG. 6 while a smooth circumference is shown in FIG. 8.

Figure 9:
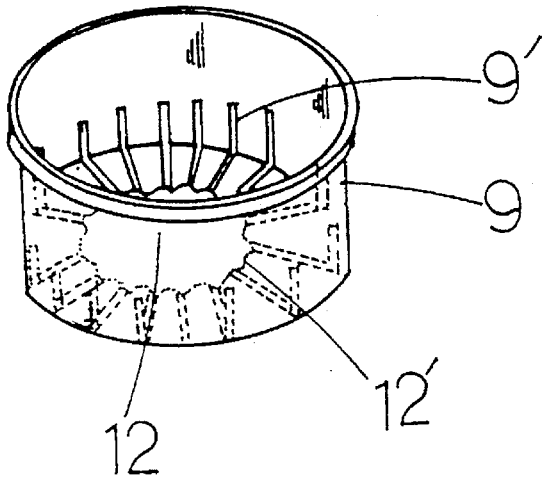
FIG. 9 is a perspective view of an insulating container according to a still further embodiment of the present invention.

Referring to FIG. 9, an inner wall of each insulating container 9*a*–9*f* may be provided with a plurality of L-shaped ribs 9' or grooves (not shown).

Figure 7:
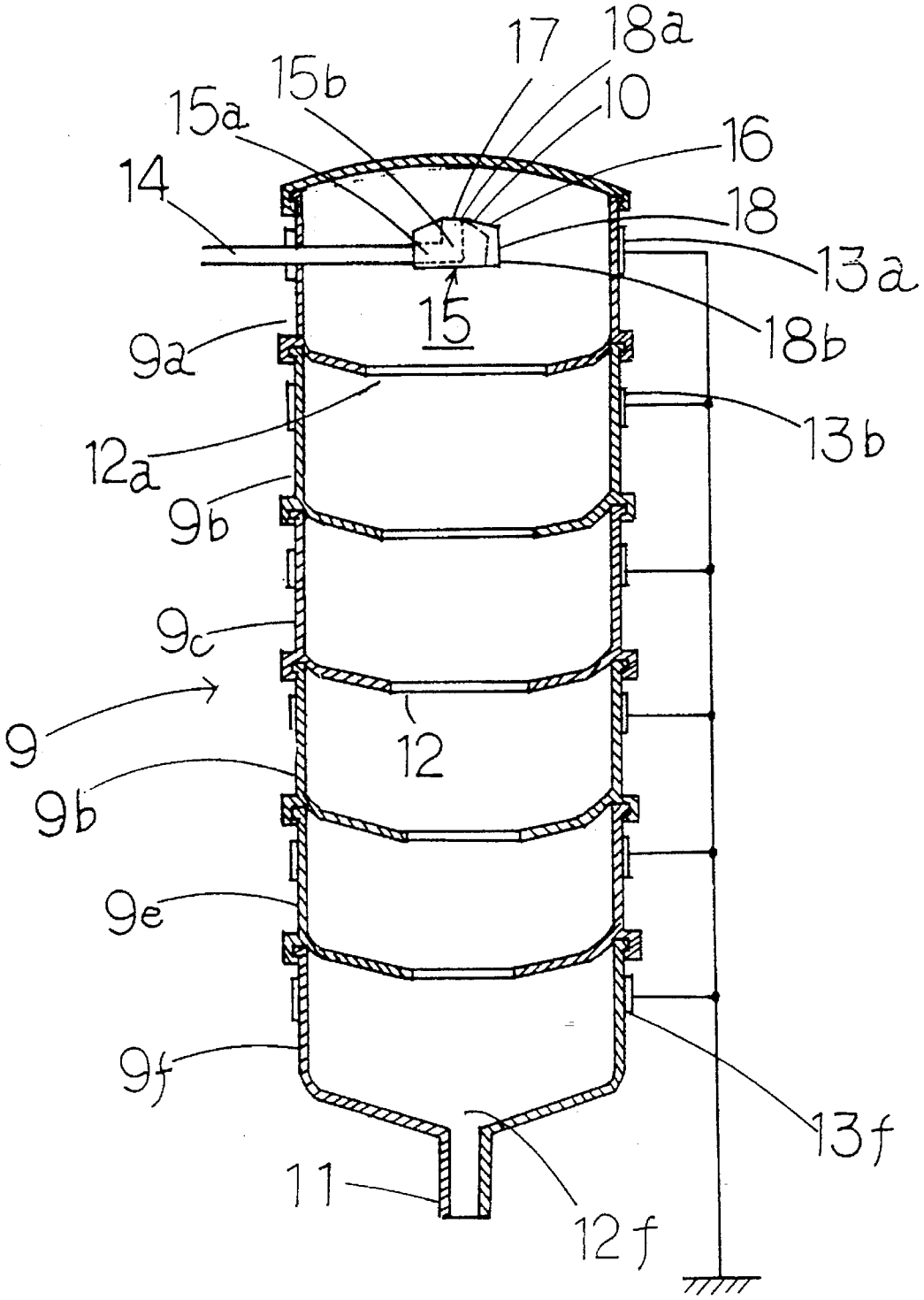
FIG. 7 is a sectional view of an insulating chamber according to a further embodiment of the present invention.

Referring to FIG. 3 and FIG. 7 an electrically conductive electrode 13*a*, 13*b*, 13*c*, 13*d*, 13*e*, and 13*f* is mounted on an exterior surface of each insulating container 9*a*–9*f*. Electrodes 13*a*–13*f* are preferably constructed of a metal such as aluminum foil. Each electrode 13*a*–13*f* forms a continuous band around each insulating container 9*a*–9*f*. A grounding wire connects each electrode 13*a*–13*f* to ground. The electrodes 13*a*–13*f* thus provide a path around an entire circumference of each insulating container 9*a*–9*f*. Charges on paint that sticks to the inner wall of container at a high potential V1 flows through the inner wall to the electrodes 13*a*–13*f* which are at a lower potential V2. Electrodes 13*a*–13*f* are sufficiently spaced from a joint portion of each container one another to prevent static discharge from joint portions to electrodes 13*a*–13*f*.

A paint inlet 10 opens upward in the center of uppermost container 9*a*. An insulating pipe 14 connected to low pressure pump 7 supplies a paint stream to paint inlet 10. The paint stream flows upward through paint inlet 10 and drips downward through openings 12*a*–12*f*. Paint inlet 10 includes a paint guide 15 and a paint dropping portion 16, both of which are made of a nonconductive material such as polyethylene or polypropylene. Paint guide 15 is elbow-shaped with a horizontal part 15*a* and a vertical part 15*b*. Insulating pipe 14 is connected to horizontal part 15*a*.

Figure 4:
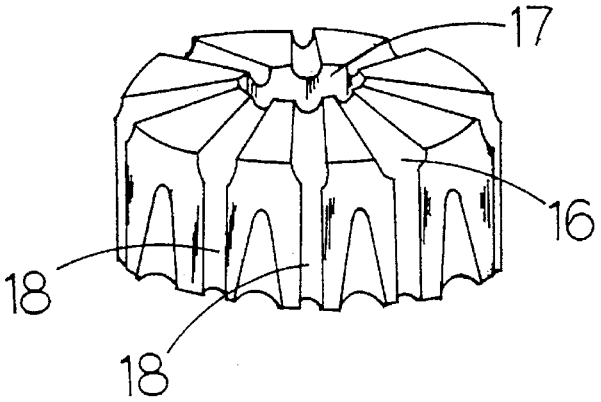
FIG. 4 is a perspective view of a paint guide.
Figure 5:
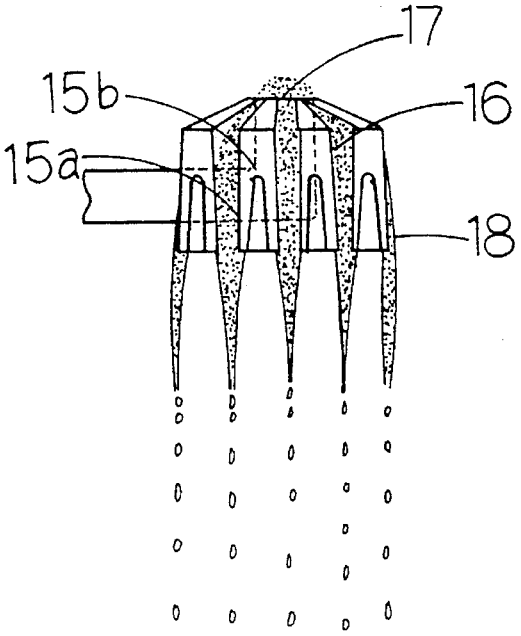
FIG. 5 is a perspective view of a paint dropping portion.

Referring to FIG. 4 and FIG. 5, a plurality of radial channels 18 are formed radially about a top opening 17 of vertical part 15*b* of paint guide 15. A paint stream flows into paint guide 15, through horizontal part 15*a*, vertical part 15*b*, and exits paint guide 15 through top opening 17. The paint stream divides into a plurality of radial substreams as it flows into a first inclined channel 18*a*, to a second channel 18*b* of each radial channel 18. Each substream divides into individual drops as it flows over a paint dropping end 16. Individual paint drops travel downward through openings 12*a*–12*e* without contacting containers 9*a* to 9*e*. Each paint flowing channel 18 is sufficiently wide to prevent the paint from clogging.

Referring to FIG. 7 an outlet 11 attaches to opening 12*f* of lowermost container 9*f*. Outlet 11 supplies the paint to the paint spraying nozzle 26. Outlet 11 also connects to a return pipe 19 for returning the paint to paint storage container 5.

To perform electrostatic painting using the present invention, a user fills paint storage container 5 with an aqueous paint. Agitator 6 stirs the paint. Programmable controller 22 starts pulse motor M. Pulse motor M drives low pressure pump 7. Low pressure pump 7 supplies the paint to paint insulator 2.

Paint supplied to paint insulator 2 flows into paint guide 15 of insulating chamber 9, through top opening 17. A plurality of radial channels 18, preferably evenly-spaced, radially divides a paint stream as it flows toward each dropping portion 16. The paint stream flows over each dropping portion 16 in vertically-spaced drops, Both radial and vertical spacing between paint drops renders the paint stream electrically discontinuous.

However, when paint sticks to the inner wall of insulating chamber 9, the voltage applied to the paint spraying nozzle 26 charges the paint stuck on the inner wall. Stuck paint attracts dropping paint, causing the dropping paint to splatter on the inner wall. Splattered paint increases the size of the charged area. Eventually, electrostatic painting becomes impossible due to excessive clogging of insulating chamber 9 and shorting of a charge applying electrode (not shown).

The present invention solves the foregoing problem by creating a leakage current to prevent excessive charging of the inner wall of the insulating chamber 9. The leakage current flows through the inner wall of the chamber, gradually bleeding the charge from the stuck paint, through electrodes 13*a*–13*f*, to ground. Gradually bleeding the charges to ground reduces clogging and splattering of paint. A charging voltage of 60 kV produces a 5–7 μA leakage current through a 1.3 mm propylene inner wall of insulating chamber 9. Electrostatic painting is possible with a leakage current of 80 μA.

The present inventor preformed a test comparing the present invention to a conventional electrostatic painting apparatus. In the test, the present inventor painted a cement block with conductive aqueous paint using a conventional electrostatic painting apparatus and an electrostatic painting apparatus according to an embodiment of the present invention and compared results.

The electrostatic painting apparatus according to an embodiment of the present invention was able to paint continuously for more than two hours, achieving an adhesive efficiency (the ratio of the paint that stuck to the block to the paint that did not stick to the block) exceeding 90% and a thickness of 150–300 μm. In contrast, the conventional apparatus painted for only an average time of 5–15 minutes before paint stuck to an inner wall of an insulating chamber and prevented further painting. The present invention thus solves a major performance problem of conventional electrostatic painting.

The following modifications are within the concept and scope of the present invention.

(1) An insulating chamber can be integral rather than being formed by a plurality of separate vertically-stacked containers.

(2) The shape of the insulating chamber may be square, elliptical or the like.

(3) The plurality of electrodes can be integrally formed on the insulating chamber.

(4) The resistance of the inner wall of the insulating material can be varied.

Figure 10:
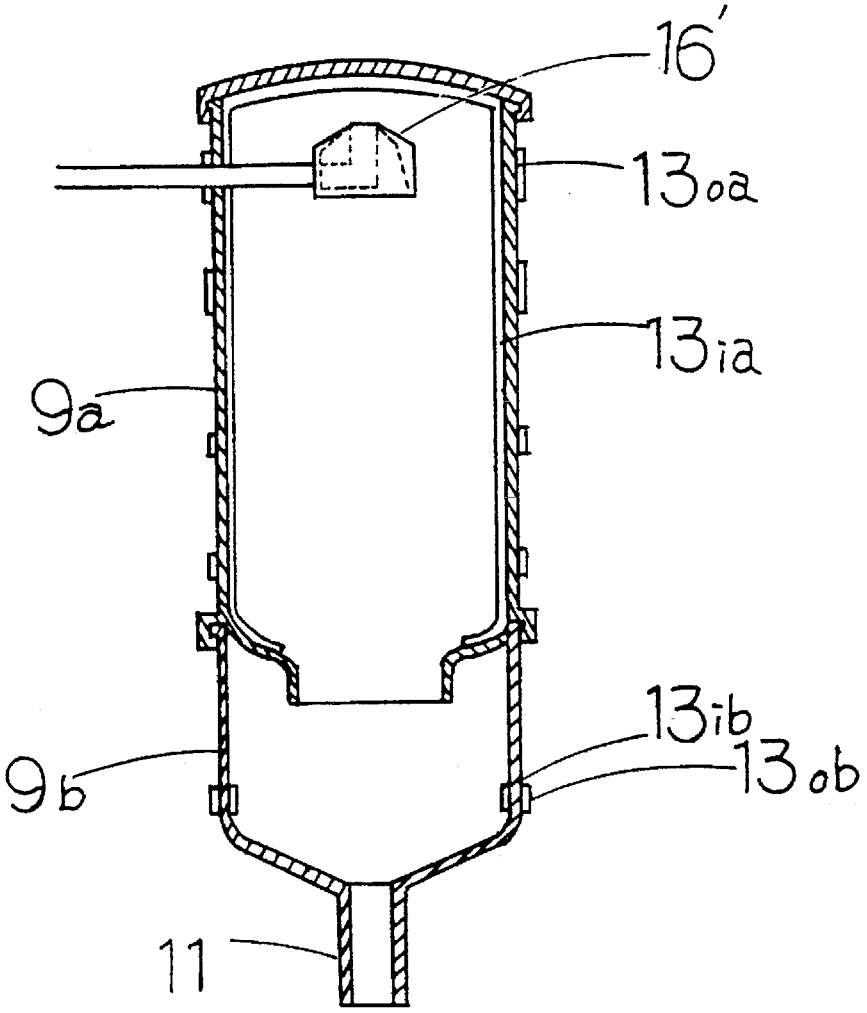
FIG. 10 is a sectional view of an insulating chamber according to a further embodiment of the present invention.

Referring to FIG. 10 a further embodiment of an insulating chamber includes an upper container 9*a* slidably inserted into a lower container 9*b*. A pair of electrodes 13*oa* and 13*ob* are mounted on an outer wall of container 9*b*, and another electrode 13*ib* is mounted on an inner wall container 9*b* opposite electrode 13*ob*. A thin electrode 13*ia* covers an inner wall of upper container 9*a*.

The pair of electrodes 13*oa* and 13*ob* are grounded, preventing charging of containers 9*a* and 9*b*. A paint drops at an accelerated speed from a paint dropping inlet (not shown) into outlet 11. Even though some paint sticks to a lower part of the inner wall of container 9*b*, current flows from electrode 13*ib*, through the inner wall of container 9*b* to electrode 13*ob* to bleed off excess charge.

In lieu of grounding electrodes 13*a*–13*f*, a resistor or a condenser can be used to reduce the electric potential of the inner wall of insulating chamber 9.

A process and apparatus according to the present invention prevents conductive paint such as an aqueous paint from shorting a charging electrode during electrostatic painting.

What is claimed is:

1. An apparatus for insulating an electrically conductive fluid, comprising:

an insulating chamber having an inlet through a top portion and an outlet through a bottom portion;

means within said insulating chamber for separating said conductive fluid into a plurality of spaced radial substreams;

means within said insulating chamber for vertically separating said substreams into drops; and at least one grounding electrode attached to an exterior of said insulating chamber;

said at least one grounding electrode being connected to a ground wherein said at least one grounding electrode allows a leakage current to bleed off an excess charge from a portion of said conductive fluid adhering to an inner wall of said insulating chamber, to said at least one grounding electrode, and to said ground.

2. Apparatus as in claim 1, wherein said insulating chamber comprises at least two vertically stacked insulating containers and said means for separating said conductive fluid into a plurality of radial substreams includes:

a conductive fluid feed means positioned in the center of an uppermost insulating container of said insulating chamber and having an upwardly facing opening; and a plurality of radial channels in said conductive fluid feed means connected to said opening, wherein a stream of said conductive fluid flows upward through said opening and divides as it flows outward through said radial channels.

3. Apparatus as in claim 1, wherein:

said insulating chamber comprises at least two stacked insulating containers, each having a bottom with an opening and an outer wall; and said outer walls of said at least two stacked insulating containers being adjacent such that said outer walls form a continuous outer wall of said vessel.

4. Apparatus as in claim 3, wherein said at least two stacked insulating containers include means for separating said at least two stacked insulating containers.

5. Apparatus as in claim 4, further comprising:

said at least one grounding electrode being on an exterior of said outer wall of one of said at least two stacked insulating containers;

at least another grounding electrode being on an exterior of said outer wall of the other of said at least two stacked insulating containers; and said at least another grounding electrode being connected to said ground.

6. Apparatus as in claim 1, wherein:

said at least one grounding electrode extends completely around said exterior of said insulating chamber; and a wall of said insulating chamber adjacent said at least one grounding electrode being sufficiently thin to allow a leakage current of a predetermined intensity to flow through said wall.

7. An apparatus according to claim 6, wherein said predetermined intensity is greater than 5 microAmperes and less than 80 microAmperes.

8. A method for preventing electrical continuity in a stream of conductive fluid, comprising:

separating said stream of conductive fluid into a plurality of spaced radial substreams at an inlet of an insulating chamber;

separating said substreams vertically into droplets inside said chamber;

dropping said droplets from a top of said insulating chamber to a bottom of said insulating chamber;

constructing said insulating chamber of an electrically insulating material;

attaching at least one grounding electrode to an exterior of said insulating chamber; and connecting said grounding electrode to a ground, wherein a charge on an inner wall of said insulating chamber flows through said inner wall, through said at least one grounding electrode, and to said ground.

9. An apparatus for insulating an electrically conductive paint supply comprising:

an insulating chamber;

said insulating chamber including an upper insulating container and a lower insulating container;

a paint inlet in an upper portion of said upper insulating container, whereby a paint enters said upper insulating container and drips downward;

an opening in a lower portion of said upper insulating container, whereby said paint exits said upper insulating container through said opening and enters said lower insulating container;

a plurality of grounding electrodes for connecting said upper insulating container to a ground;

said plurality of grounding electrodes mounted on an exterior surface of said upper insulating container;

an inner electrode covering an inner surface of said upper insulating container;

said lower insulating container connected to said upper insulating container;

a paint outlet in a lower portion of said lower insulating container;

a plurality of inner electrodes mounted on an inner surface of said lower insulating container; and a plurality of outer electrodes for connecting said lower insulating container to said ground;

said plurality of outer electrodes being mounted on an outer surface of said lower insulating container, located opposite said plurality of inner electrodes of said lower insulating container.

10. Apparatus according to claim 9, wherein said paint inlet includes a plurality of radial channels for separating said paint into a plurality of radial substreams before said paint drips downward.

11. An apparatus for insulating an electrically conductive fluid, comprising:

an insulating chamber having an inlet through a top portion and an outlet through a bottom portion;

means within said insulating chamber for separating said conductive fluid into a plurality of spaced radial substreams;

means within said insulating chamber for vertically separating said substreams into drops; and at least one electrode attached to an exterior of said insulating chamber;

said at least one electrode being connected to a resistor, wherein said at least one electrode allows a leakage current to bleed off an excess charge from a portion of said conductive fluid adhering to an inner wall of said insulating chamber, to said at least one electrode, and to said resistor.

12. A method for preventing electrical continuity in a stream of conductive fluid, comprising:

separating said stream of conductive fluid into a plurality of spaced radial substreams at an inlet of an insulating chamber;

separating said substreams vertically into droplets inside said chamber;

dropping said droplets from a top of said insulating chamber to a bottom of said insulating chamber;

constructing said insulating chamber of an electrically insulating material;

attaching at least one electrode to an exterior of said insulating chamber; and connecting said electrode to a resistor, whereby a charge on an inner wall of said insulating chamber flows through said inner wall, through said at least one electrode, and to said resistor.

13. An apparatus for insulating an electrically conductive fluid, comprising:

an insulating chamber having an inlet through a top portion and an outlet through a bottom portion;

means within said insulating chamber for separating said conductive fluid into a plurality of spaced radial substreams;

means within said insulating chamber for vertically separating said substreams into drops; and at least one electrode attached to an exterior of said insulating chamber;

said at least one electrode being connected to a condenser, wherein said at least one electrode allows a leakage current to bleed off an excess charge from a portion of said conductive fluid adhering to an inner wall of said insulating chamber, to said at least one electrode, and to said condenser.

14. A method for preventing electrical continuity in a stream of conductive fluid, comprising:

separating said stream of conductive fluid into a plurality of spaced radial substreams at an inlet of an insulating chamber;

separating said substreams vertically into droplets inside said chamber;

dropping said droplets from a top of said insulating chamber to a bottom of said insulating chamber;

constructing said insulating chamber of an electrically insulating material;

attaching at least one electrode to an exterior of said insulating chamber; and connecting said electrode to a condenser, wherein a charge on an inner wall of said insulating chamber flows through said inner wall, through said at least one electrode, and to said condenser.

* * * * *